US005328231A

United States Patent [19]

Raymond

[11] Patent Number: 5,328,231

[45] Date of Patent: Jul. 12, 1994

[54] EQUAL ACCESS SEATING

[75] Inventor: David W. Raymond, Grand Rapids, Mich.

[73] Assignee: American Seating Company, Grand Rapids, Mich.

[21] Appl. No.: 658,918

[22] Filed: Feb. 21, 1991

[51] Int. Cl.[5] ..... A47C 3/18

[52] U.S. Cl. ..... 297/13; 297/232; 297/335; 297/240

[58] Field of Search ..... 297/13, 142, 232, 240, 297/331, 332, 334; 248/145

[56] References Cited

U.S. PATENT DOCUMENTS

| | | | |
|---|---|---|---|
| 656,583 | 8/1900 | Levin | 297/13 |
| 941,983 | 11/1909 | Elsner | 297/335 X |
| 1,007,041 | 10/1911 | Miller | 297/335 X |
| 1,015,799 | 1/1912 | Haren | 297/375 X |
| 1,318,439 | 10/1919 | Erickson | 297/13 |
| 2,235,751 | 3/1941 | Sears | 297/335 X |
| 2,953,288 | 9/1960 | Peterson | 297/191 X |
| 3,044,828 | 7/1962 | Fowler | 297/191 |
| 4,189,876 | 2/1980 | Crossman et al. | 52/9 |

FOREIGN PATENT DOCUMENTS

| | | | |
|---|---|---|---|
| 503969 | 4/1939 | United Kingdom | 297/142 |

*Primary Examiner*—Peter R. Brown
*Attorney, Agent, or Firm*—Dykema Gossett

[57] ABSTRACT

A compactible, storable seating apparatus of the type which yields way to accommodate a wheelchair user. The apparatus has a seat bottom and seat back which rotate about a common axis to compact in a vertical position. The seat bottom and back are mounted to a common cantilevered beam which is pivotal about a single stanchion. The seating apparatus can be used in a conventional manner or can be easily pivoted about the stanchion to yield way to a wheelchair user.

27 Claims, 3 Drawing Sheets

EQUAL ACCESS SEATING

BACKGROUND OF THE INVENTION

This invention relates generally to auditorium or stadium-type seating, and more particularly relates to auditorium or stadium-type seating which readily yields way to accommodate a person using a wheelchair.

In the past, persons confined to a wheelchair have had great difficulty in viewing a program at an auditorium or a stadium. The difficulty arises because auditoriums and stadiums do not typically incorporate viewing locations which are dedicated to accommodate a wheelchair. This, in turn, means that the number of wheelchair patrons which will be attending a function must be made known ahead of time whereby the appropriate number of seats can be physically removed from a designated area and stored. The space created from the removal of the seats can then be used by wheelchair personnel to enjoy the program.

This approach, although widely used, has several drawbacks. Firstly, the number of wheelchair persons must be made known ahead of time. Thus, the system is relatively inflexible inasmuch as it cannot accommodate any last minute cancellations or additions. Accordingly, wheelchair persons arriving unannounced must often be turned away and spaces dedicated for wheelchair users who cancel at the last minute or do not make their cancellation known, must go unused if sufficient time is not provided to reinstall the appropriate number of seats. Secondly, it is labor intensive, and, costly.

Accordingly, it can be seen that there is a need for a seat which can be readily displaced for accommodating a person in a wheelchair.

It is an object of this invention to provide a compactible, seating apparatus of the type which yields way to accommodate an individual in a wheelchair.

It is also an object of the invention to provide a compactible seating apparatus which, when it is not displaced for accommodating an individual in a wheelchair, allows the seating space to be utilized in a conventional manner.

It is an additional object of this invention to provide a compactible seating apparatus which can be quickly displaced from conventional usage to a store position.

It is a further object of this invention to provide a compactible seating apparatus which is economical to manufacture and maintain and extremely durable.

SUMMARY OF THE INVENTION

The compactible seating apparatus of the present invention has a single stanchion, a seat bottom and a seat back. The seat bottom and back are both pivotally connected to the stanchion. The stanchion includes a pivoting means for pivoting the seat bottom and the seat back from a use position into a store position. When the seat is in the store position a wheelchair user is provided with sufficient clearance to reside in the space occupied by the seat bottom and the seat back when the seat is in the use position.

In a preferred embodiment the storable seat includes a locking means for locking the chair in either the use position or the store position. Additionally, the storable seat preferably includes a stop means for preventing the pivoting seat from being pivoted substantially beyond its use position or store position.

The stanchion preferably includes a cantilever arm which is pivotally connected to a base support by way of the pivoting means. The seat bottom and seat back are preferably pivotally mounted to the cantilever arm. In a preferred embodiment, the pivotal axis of the cantilever arm is offset from the seat. By offsetting the pivotal axis of the cantilever arm from the seat, the seat is substantially displaced from the elbow area of the wheelchair user whenever the seat is pivoted (into the store position) to accommodate a wheelchair user. Accordingly, the seat of the present invention does not unduly restrict the arm and elbow movement of the wheelchair user.

The seat preferably includes articulating arm supports which collapse out of the way when the seat is not used and a single support stanchion is preferred for supporting the seat whereby substantial under seat access is granted to maintenance personnel for cleanup, etc.

DETAILED DESCRIPTION OF THE PREFERRED EMBODIMENTS

Figure 1:
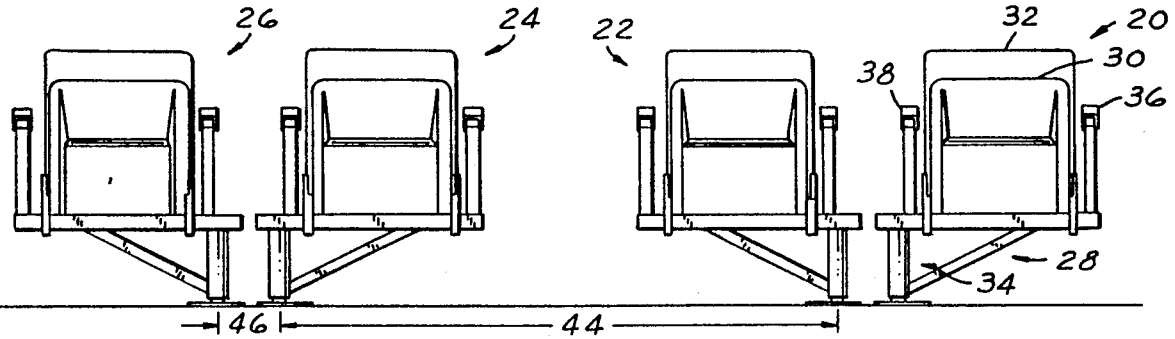
FIG. 1 is a front plan view of a row of four seats of the present invention, all of which are shown in a use position.
Figure 3:
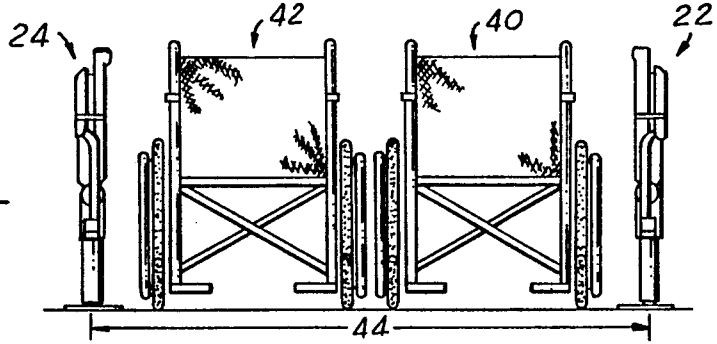
FIG. 3 is a front plan view of two of the seats of FIG. 2 wherein both seats have been pivoted into a store position and two wheelchairs reside side by side in the space created by the stored seats.

Now referring to FIGS. 1 and 3, compactible, storable seat 20 is typically arranged in rows of other like seats 22–26. Each seat 20 is comprised of a single stanchion 28, a seat bottom 30 pivotally connected to the stanchion 28 and a seat back 32 pivotally connected to the stanchion 28. Stanchion 28 further includes pivoting means 34 for pivoting seat bottom 30 and seat back 32 from a use position into a store position. This feature of the disclosed invention will be discussed in further detail in conjunction with the subsequent figures. Seat 20 preferably includes articulated arm rests 36, 38. The row of seats set out in FIG. 1 exemplifies the position that seats 20–26 would be manipulated into when they are to be occupied in a conventional manner.

Seats 20–26 within each row of seats are preferably spaced such that each stanchion 28 has a short distance neighbor 46 and a long distance neighbor 44. The short distance neighbor 46 must be of sufficient distance to allow the stanchions of each seat 24, 26 to freely pivot from the use position to the store position without interference from the adjacent seat. The long neighbor 44 must be of sufficient length to allow two conventional wheelchairs to reside side by side within the space provided when adjacent, long neighbor seats 22, 24 are manipulated into their store position (see FIG. 3).

Figure 2:
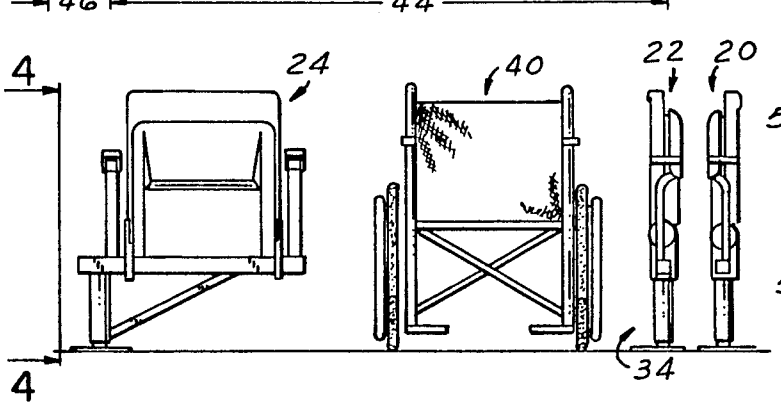
FIG. 2 is a front plan view of three of the seats of FIG. 1 wherein two of the three seats have been rotated into a store position and a wheelchair resides in an open space created by one of the seats.
Figure 6:
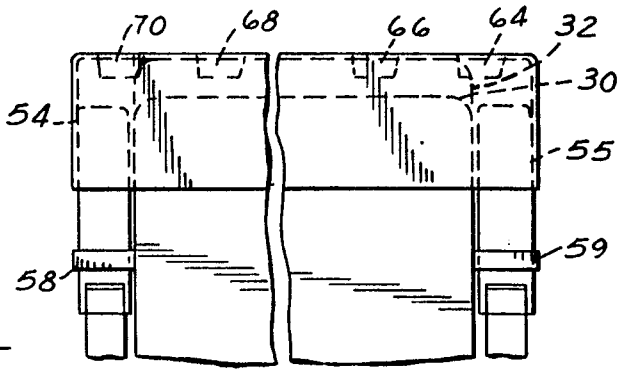
FIG. 6 is a front view taken substantially along lines 6—6 of FIG. 5.

Now referring to FIG. 2, when a wheelchair user desires to occupy the space of one of the seats 20–26, the appropriate seat (for example seat 22 of FIG. 2) is pivoted about pivoting means 34 thereby providing sufficient room for wheelchair 40 to be manipulated into place. In this position, the user of wheelchair 40 can enjoy the entertainment. Because no special tools are needed to manipulate seat 22 from its use position into its store position, it may be quickly manipulated to accommodate a wheelchair user without necessitating advance notice. This is in stark contrast to existing methods whereby conventional seating must be unbolted from the floor and carried away and stored.

Figure 4:
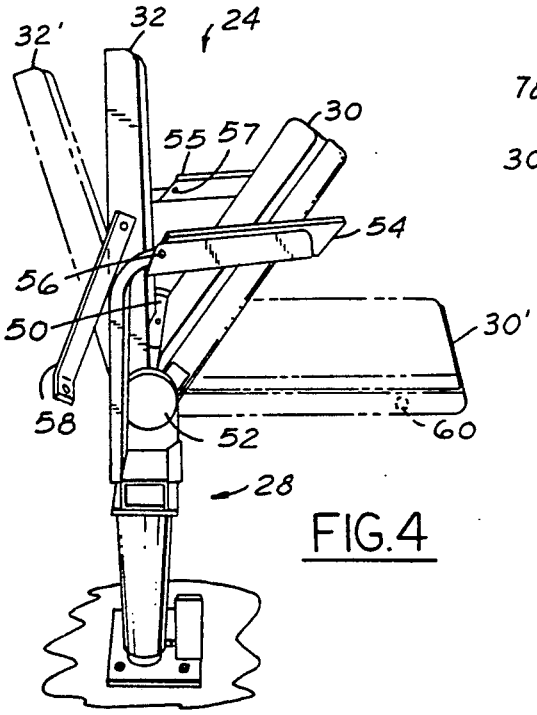
FIG. 4 is a side perspective view of one of the seats of the present invention taken substantially along lines 4—4 of FIG. 2.

Now referring to FIG. 4, seat 24 exemplifies the design of both righthand and lefthand seats of the present invention. As can be seen from FIG. 1, adjacent seats (e.g. 24, 26) are not identical inasmuch as they are designed to pivot in opposite directions. For example, when viewed from the top, seat 26 pivots in a counterclockwise direction when moved from its use position to its store position as contrasted to the clockwise motion of seat 24 when it is moved from its use position to its store position. Notwithstanding this difference in symmetry, the functional features of each of the righthand and lefthand seat 24, 26 are identical and accordingly, only the right-handed seat 24 will be discussed in detail. With this in mind, it is to be understood that all discussion which relates to righthand seat 24 also directly relates to lefthand seat 26.

When seat 24 is in its use position, but unoccupied, seat bottom 30 and seat back 32 will assume the position shown in FIG. 4. When seat 24 is occupied, seat bottom 30 and seat back 32 will assume the position indicated in phantom (indicated at reference numeral 30', 32'). The mechanism which allows seat bottom 30 and seat back 32 to pivot in this way, is seat bottom and back hinge mechanism 50, 52. Mechanism 50, 52 is the subject of U.S. Pat. No. 4,189,876 assigned to the same assignee as that of the present invention and is hereby incorporated by reference.

Figure 5:
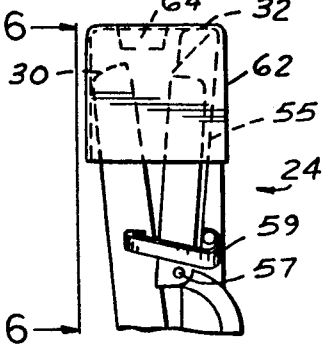
FIG. 5 is a side view of the seat of FIG. 4 when the back and seat portion are covered by a cap.

When it is desired to manipulate seat 24 from its use position to its store position, seat bottom 30 and back 32 are pivoted about hinge mechanism 50, 52 until they are brought into contact with one another (see FIG. 5 which shows this generally vertical face to face relationship between seat bottom 30 and seat back 32). While seat bottom 30 and seat back 32 are held in this vertical position, righthand and lefthand articulated arm rests 54, 55 are pivoted until they are positioned in their vertical most orientation. With seat bottom 30, seat back 32 and arm rests 54, 55 in their above-mentioned positions, retaining strap 58 is looped around the outside of arm rest 54 and attached to retaining peg 60 of seat bottom 30 and restraining strap 59 (not shown in this view) is looped around arm 55 and fastened to retaining peg 61 (not shown).

Now referring to FIG. 5, the final upright position of seat bottom 30, seat back 32 and articulated arm rests 54, 55 is exemplified in FIG. 5. By retaining seat bottom 30, seat back 32 and arm rests 54, 55 in this upright position, these components are compacted into a space which is smaller than they would otherwise require and accordingly, once pivoted into the store position, an adjacent wheelchair user is able to enjoy the use of space adjacent his arm and elbow area that would not otherwise be available.

Once seat bottom 30, seat back 32 and right and lefthand articulated arm rests 54, 55 are secured in their vertical positions by right and lefthand retaining straps 58, 59, rigid cap 62 may be fitted over the top portion of seat bottom 30, seat back 32 and arm rests 54, 55. Cap 62 primarily serves as a table surface whereby beverages and the like can be placed within a plurality of depressions 64–70. Cap 62 also provides a secondary function of protecting seat bottom 30 and seat back 32 of seat 24 from soiling due to atmospheric elements or spilled food products and the like.

Figure 7:
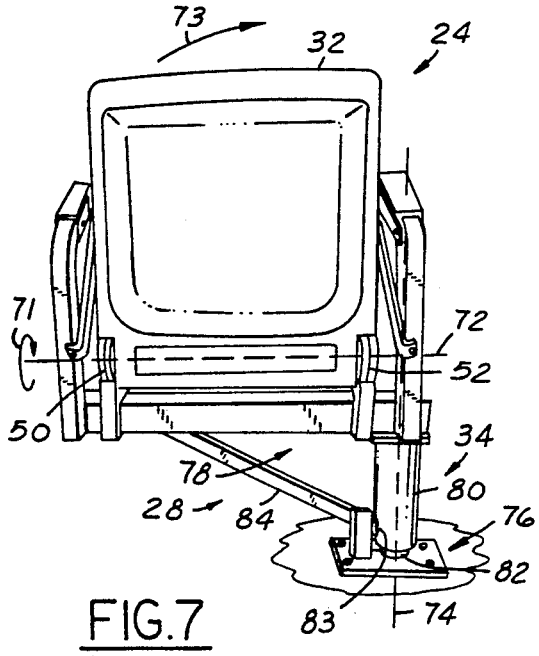
FIG. 7 is a rear perspective view of the seat of FIG. 4.

Now referring to FIG. 7, as was mentioned earlier, seat back 32 and seat bottom 30 (seat bottom 30 not visible in FIG. 7) are attached to stanchion 28 via hinge mechanisms 50, 52. Hinge mechanisms 50, 52 permit seat bottom 30 and seat back 32 to pivot about a common horizontal axis 72. Distinct from this pivoting motion of seat bottom 30 and seat back 32, pivoting means 34 permits seat 24 to pivot in a horizontal plane 73 about vertical axis 74. The ability of seat 24 to pivot in a horizontal plane 73 about vertical axis 74 is the means by which seat 24 is easily movable from a use position into a store position.

Stanchion 28 preferably comprises base support 76 and cantilever arm 78. Base support 76 and cantilever arm 78 are connected by pivoting means 34. Pivoting means 34 is formed from hollow tube portion 80 of said cantilever arm 78 which is adapted to fit over and rotate about vertical post 82 of base support 76. By designing hollow tube portion 80 to fit around the outside of vertical post 82, two important design features are introduced. Firstly, the majority of contact surfaces between vertical post 82 and hollow tube 80 are protected from atmospheric contaminants, food stuff, debris and the like, which, if allowed to contact these inner working surfaces of said pivoting means may accelerate wear or eventually impair the seat's ability to pivot. Secondly, by designing hollow tube 80 to surround vertical post 82 a convenient surface 83 is available to mount brace member 84. It is important to note that although the preferred embodiment of seat 24 includes brace member 84, it is contemplated that similar seat designs could be used without the presence of brace 84. While it is understood that the presence of brace 84 prevents beam 78 from being a true cantilever beam, beam 78 is referred to as such and is to be interpreted to include seat assemblies with or without brace members 84.

Figure 8:
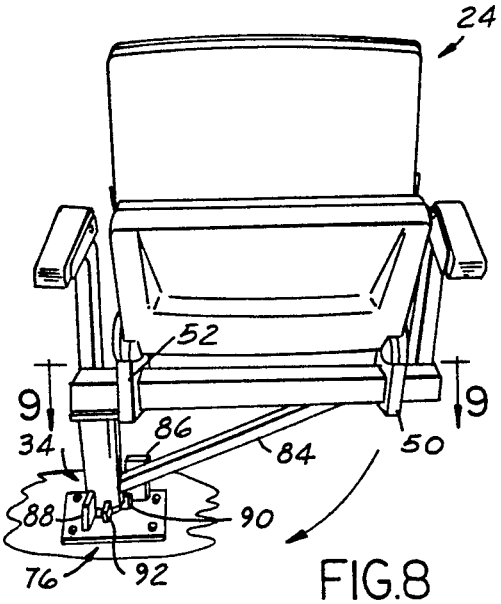
FIG. 8 is a front perspective view of the seat of FIG. 4.

Now referring to FIGS. 7 and 8, base support 76 is fitted with first and second stop blocks 86, 88. First stop block 86 is welded to base support 76 and is positioned thereon to prevent seat 24 from rotating substantially beyond its use position. Accordingly, when seat 24 is rotated to its use position, brace 84 contacts first stop block 86 and is prevented from rotating any further. Likewise, when seat 24 is rotated to its store position, brace 84 contacts second stop block 88 thereby ceasing any further pivotal movement. Stop blocks 86, 88 are seen as an important feature of the present invention inasmuch as they prevent someone from "over rotating" the seat. First and second lock mechanism 90, 92 are provided for positively engaging seat 24 in its use position and store position respectively. These features of the present invention will be described in greater detail in conjunction with FIGS. 11–14.

Figure 9:
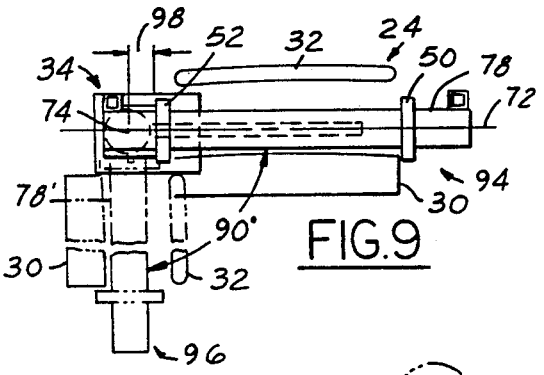
FIG. 9 is a diagrammatic top view of the rotating action of the cantilever beam portion of the seat of the present invention.

Now referring to FIG. 9, the pivotal movement of cantilever arm 78 from the use position 94 to the store position 96 is accomplished by rotating cantilever beam 78 about pivot means 34. Pivot means 34 allows cantilever beam 78 to pivot about vertical axis 74 thereby providing a simple, but effective, way to move seat 24 into and out of its use/store positions. An important aspect of the present invention is the manner in which vertical axis 74 of pivoting means 34 is displaced 98 from seat bottom 30 and seat back 32. By providing displacement 98, the seat bottom 30 and seat back 32 will be displaced from the arm and elbow area of a wheelchair user thus guaranteeing the wheelchair user freedom of movement when seat 24 is in the store position.

Figure 10:
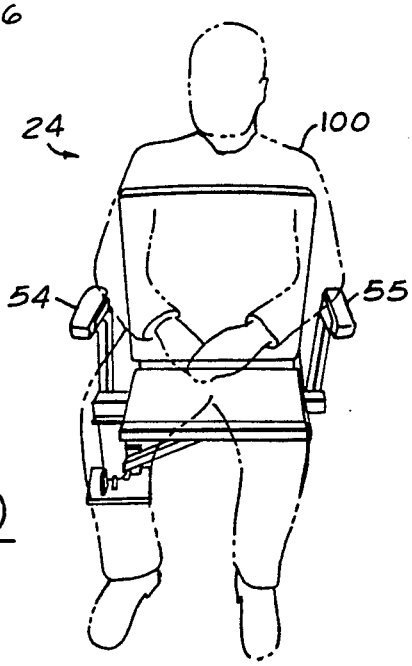
FIG. 10 is a front perspective view of the seat of the present invention as it relates relative to a user.

Now referring to FIG. 10, seat 24 is shown in its use position whereby it is occupied by user 100 in a conventional manner. Articulated arm rests 54, 55 are positioned in their horizontal orientation to comfortably support the elbows of user 100.

Figure 11:
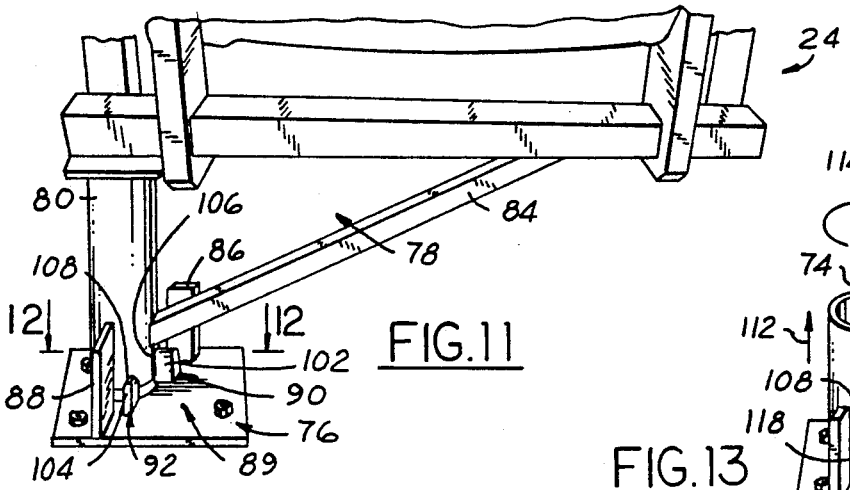
FIG. 11 is a partial perspective view of a first embodiment of a locking means of the present invention shown locked in its use position.
Figure 13:
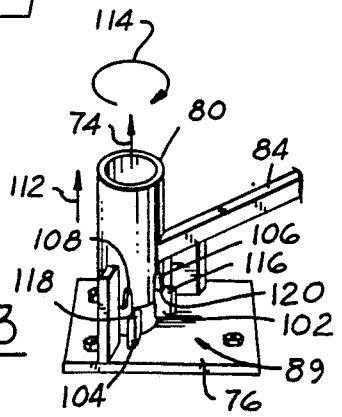
FIG. 13 is a partial perspective view of the locking means of FIG. 11 in its unlocked position.

Now referring to FIGS. 11 and 13, a first embodiment of locking means 89 includes first lock mechanism 90 and second lock mechanism 92. Lock mechanisms 90, 92 are comprised of a locking finger 102, 104 mounted to base support 76 and corresponding locking notches 106, 108 (see FIG. 13) residing in hollow tube portion 80 of cantilever beam 78. Locking fingers 90, 92 are adapted to engage their respectively associated locking notch 106, 108 thereby preventing any pivotal movement of seat 24 about base support 76.

Figure 12:
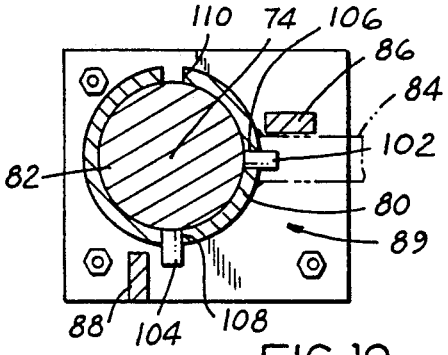
FIG. 12 is a cross-sectional view taken substantially along lines 12—12 of FIG. 11 showing the locking means locked in the use position.

Now referring to FIG. 12, hollow tube 80 is fitted with three locking notches—106, 108 and 110. Notch 110 is not used when seat 24 is in the use position. Notch 110 is used, however, when seat 24 is in the store position. The manipulation of seat 24 from the use position to the store position will now be explained.

Figure 14:
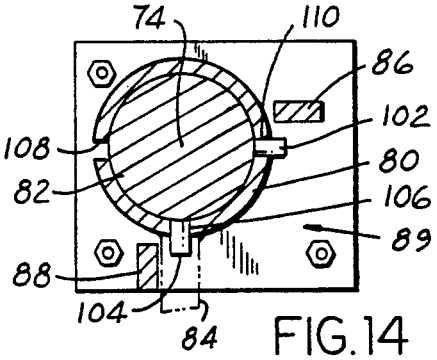
FIG. 14 is a cross-sectional view of the locking means of FIG. 11 shown locked in the store position.

Now referring to FIGS. 11, 13 and 14, when it is desired to manipulate seat 24 from the use position to the store position, an upward force is placed on seat 24 thereby pulling hollow tube 80 away from base support 76 which in turn causes locking notches 106, 108 to disengage from their respective locking fingers 102, 104. While notches 106, 108 are disengaged from fingers 102, 104, seat 24 is slightly rotated 114 about vertical axis 74 and then lowered, such that the upper surfaces 116, 118 of each locking finger 102, 104, ride the flat portion 120 of hollow tube 80. Once this maneuvering is accomplished, upward force 112 may be removed and seat 24 is rotated 114 about axis 74 until slot 110 engages locking finger 102 and slot 106 engages finger 104. Once this engagement has occurred, seat 24 will have assumed its store position and the relative position of notches 106, 108 and 110 vis-a-vis locking fingers 102, 104 will be as depicted in FIG. 14. Note that in the store position, notch 108 is not engaged by either locking finger 102, 104 and notch 110 is in locking engagement with locking finger 102. As was already mentioned, stop blocks 86, 88 prevent someone from "over rotating" the seat. Additionally, they prevent excessive wear between fingers 102, 104 and notches 106, 108 and 110 by absorbing much of the torsional forces present when cantilever beam 78 pivots into the use or store position. Without blocks 86, 88 present, fingers 102, 104 and notches would wear much quicker inasmuch as they would absorb the brunt of the momentum as the seat makes the transition from pivoting to locking.

Figure 15:
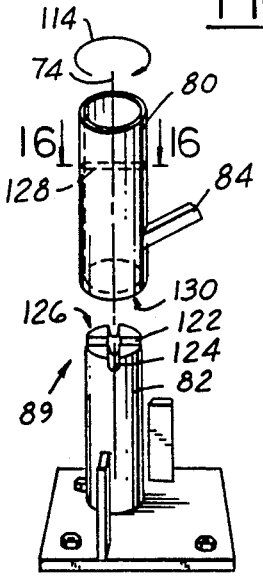
FIG. 15 is a partial perspective, exploded view of a second embodiment of the seat locking means of the present invention.

Now referring to FIG. 15, in a second embodiment of locking means 89, vertical post 82 is fitted with first and second depressions 122, 124 on its uppermost end 126. Locating pin 128 spans inner opening 130 of hollow tube 80. Locating pin 128 is adapted to engage first depression 122 when seat 24 is in its use position and, pin 128 is adapted to engage second depression 124 when seat 24 is in its store position.

Figure 16:
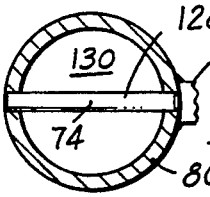
FIG. 16 is a cross-sectional view taken substantially along lines 16—16 of FIG. 15.
Figure 17:
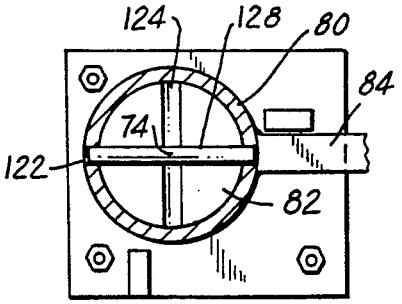
FIG. 17 is a top view of the second embodiment of the locking means when the seat is in the use position.
Figure 18:
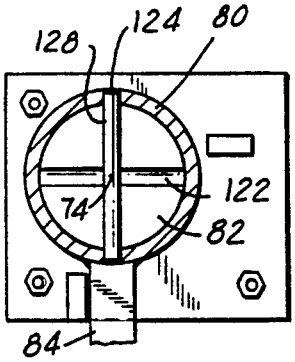
FIG. 18 is a top view of the second embodiment of the locking means when the seat is in the store position.

Now referring to FIG. 16, pin 128 is preferably fastened to hollow tube 80 such that it spans across the diameter of inner opening 130. Pin 128 is preferably mounted to tube 80 by drilling a hole through the diameter thereof and press fitting pin 128 into the hole. The operation of the second embodiment of a locking mechanism will now be explained in conjunction with FIGS. 11, 15, 17 and 18.

Now referring to FIGS. 11, 15, 17 and 18, when seat 24 is disposed in its use position, pin 128 will reside in first depression 122. Thus, any urging of seat 24 about axis 74 will be resisted by the cooperation of pin 128 within first depression 122. When it is desired to rotate seat 24 from the use position to the store position, one simply exerts sufficient upward force on seat 24 to separate pin 128 from first depression 122. When the separation is accomplished, seat 24 is slightly rotated 114 about axis 74 such that pin 128 does not re-engage slot 122 (when seat 24 is set back down upon vertical post 82). Once this lift, rotate and lower motion is accomplished, further pivoting 114 of seat 24 will cause pin 128 to ride across uppermost end 126 of post 82 until it is substantially aligned with second depression 124. Once this substantial alignment takes place, pin 128 will engage second depression 124 (see FIG. 18) and maintain seat 24 in the store position.

While the foregoing description of the invention has been made with respect to preferred embodiments, persons skilled in the art will understand, in light of the present disclosure, that numerous changes, modifications and alterations may be made therein without departing from the spirit and the scope of the appended claims. For example, it is contemplated that a lift restraint system will accompany the preferred embodiment of the present invention. This restraint system, in its simplest form, will comprise a cable or chain segment which has its opposing ends attached to cantilevered beam 78 and base support 76 respectively. The chain or cable will be loose enough so as to not interfere with the pivotal action of the seat but short enough to prevent brace 84 from being lifted over stop blocks 86, 88. If brace 84 were permitted to be lifted over stop blocks 86, 88, an "over rotation" condition could exist, as was previously discussed. Therefore, all such changes, modifications and alterations are deemed to be within the scope of the invention as defined in the following claims.

I claim:

1. A compactible seating apparatus of the type which yields way to accommodate an individual in a wheelchair, comprising:

a seat bottom pivotal about a first axis;

a seat back pivotal about said first axis;

a cantilever beam connected to said seat bottom and seat back;

a support stanchion pivotally attached to said cantilever beam, and wherein said cantilever beam is adapted to pivot in relation to said stanchion about a second axis, said second axis being generally perpendicular to said first axis and displaced from said seat bottom and said seat back, wherein when said cantilever beam is pivoted about said second axis from a use position to a store position, said seating apparatus yields way to accommodate an individual in said wheelchair.

2. The seating apparatus of claim 1, wherein said cantilever beam is adapted to pivot forwardly in relation to said stanchion about said second axis.

3. The storable seat of claim 1, further including a locking means attached to said support stanchion and said cantilever beam for:

locking said cantilever beam when said storable seat is in said use position; and locking said cantilever beam when said storable seat is in said store position.

4. The storable seat of claim 3, wherein said stanchion is further comprised of a base support and wherein said locking means comprises:

a locking finger extending from said base support;

first and second spaced apart locking notches residing in said cantilever beam;

wherein said locking finger is adapted to engage said first locking notch when said storable seat is in said use position, and wherein said locking finger is adapted to engage said second locking notch when said portable seat is in said store position.

5. The storable seat of claim 4, wherein said locking finger is disengaged from one of said first and second notches by lifting said cantilever beam vertically upwardly and rotating said cantilever beam about said pivoting means.

6. The storable seat of claim 3, wherein said stanchion is further comprised of a base support, said base support and said cantilever beam connected by a pivoting means and wherein said locking means comprises:

a locating pin fixed to and extending from said cantilevered beam; and first and second recessed portions within said base support;

wherein said locating pin is adapted to engage said first recessed portion when said storable seat is in said use position, and wherein said locating pin is adapted to engage said second recessed portion when said storage seat is in said store position.

7. The storable seat of claim 6, wherein said locking finger is disengaged from one of said first and second recessed portions by lifting said cantilever beam vertically upwardly and rotating said cantilever beam about said pivoting means.

8. The storable seat of claim 7, wherein said cantilever arm further includes a hollow tube portion adapted to cover said base support to protect said base support from contamination.

9. The storable seat of claim 1, further including a first stop means for preventing said storable seat from pivoting substantially beyond said use position and a second stop means for preventing said storable seat from pivoting substantially beyond said store position.

10. The storable seat of claim 1, further including first and second articulated arm rests, whereby said arm rests are adapted to be manipulated in a first generally horizontal position when said storable seat is in said use position and are adapted to be manipulated in a second generally vertical position when said storable seat is in said store position.

11. The storable seat of claim 1, wherein said seat back and said seat bottom are sufficiently pivotal about said cantilever beam wherein they are adapted to assume a generally vertical face to face relationship with each other.

12. The storable seat of claim 11, further including a retention strap for maintaining said seat back and said seat bottom in a vertical face to face relationship with each other after they have been so manipulated.

13. The storable seat of claim 12, further including a rigid cap for covering a vertical most extent of said seat back and said seat bottom after they are manipulated into a vertical face to face relationship, wherein said cap includes a plurality of depressions for securely retaining a beverage container.

14. A pair of storable seats, each seat adapted to assume a use position and a store position, said store position allowing each said seat to yield way to accommodate an individual in a wheelchair, comprising:

a first counter-clockwise rotatable seat and a second, clockwise rotatable seat defining a pair of neighboring seats each seat in said pair of seats including, a seat back and a seat bottom, a cantilever beam having first and second spaced apart ends, said first end supporting said seat back and said seat bottom, a support stanchion pivotally connected to said second end of said cantilever beam, wherein said pair of neighboring seats are arranged such that when they are placed in their use position they face a generally common direction and said seat back and said seat bottom of said first seat are proximate said seat back and said seat bottom of said second seat, and said support stanchion of said first seat is distal said support stanchion of said second seat, and wherein said support stanchion of said first seat is spaced from said support stanchion of said second seat such that when said pair of seats are placed in their store position, sufficient unobstructed space exists between said stanchions of said first and second seats to accommodate two individuals, each in a wheelchair.

15. The pair of storable seats of claim 14, wherein the cantilever beam of said first and second seats is adapted to pivot forwardly.

16. The pair of storable seats of claim 14, wherein each seat further includes a locking means attached to said support stanchion and said cantilever beam for:

locking said cantilever beam when said storable seat is in said use position; and locking said cantilever beam when said storable seat is in said store position.

17. The pair of storable seats of claim 16, wherein each said stanchion further includes a base support and wherein said locking means comprises:

a locking finger extending from said base support;

first and second spaced apart locking notches residing in said cantilever arm;

wherein said locking finger is adapted to engage said first locking notch when said storable seat is in said use position, and wherein said locking finger is adapted to engage said second locking notch when said portable seat is in said store position.

18. The pair of storable seats of claim 17, wherein said locking finger of each said seat is disengaged from one of said first and second notches by lifting said cantilever arm vertically upwardly and pivoting said cantilever arm about said support stanchion.

19. The pair of storable seats of claim 16, wherein said stanchion of each said seat is further comprised of a base support, and wherein said locking means comprises;

a locating pin fixed to and extending from said cantilevered arm; and first and second recessed portions within said base support;

wherein said locating pin is adapted to engage said first recessed portion when said storable seat is in said use position, and wherein said locating pin is adapted to engage said second recessed portion when said storage seat is in said store position.

20. The pair of storable seats of claim 19, wherein said locking finger of each said seat is disengaged from one of said first and second recessed portions by lifting said cantilever arm vertically upwardly and pivoting said cantilever arm about said support stanchion.

21. The pair of storable seats of claim 20, wherein each said cantilever arm of each seat further includes a hollow tube portion adapted to cover said base support to protect said base support from contamination.

22. The pair of storable seats of claim 14, wherein each said seat further includes a first stop means for preventing said storable seat from pivoting substantially beyond said use position and a second stop means for preventing said storable seat from pivoting substantially beyond said store position.

23. The pair of storable seats of claim 14, wherein said cantilever arm of each seat is adapted to pivot about a substantially vertical axis and wherein said seat bottom and said seat back are pivotally connected to said cantilever arm and wherein said vertical axis is displaced from said seat back and seat bottom.

24. The pair of storable seats of claim 14, wherein each seat further includes first and second articulated arm rests, whereby said arm rests are adapted to be manipulated in a first generally horizontal position when said storable seat is in said use position and are adapted to be manipulated in a second generally vertical position when said storable seat is in said store position.

25. The pair of storable seats of claim 14, wherein said seat back and said seat bottom of each seat are pivotal about said cantilever beam wherein they are adapted to assume a generally vertical face to face relationship with each other.

26. The pair of storable seats of claim 25, wherein each seat further includes a retention strap for maintaining said seat back and said seat bottom in a vertical face to face relationship with each other after they have been so manipulated.

27. The pair of storable seats of claim 26, wherein each seat further includes a rigid cap for covering a vertical most extent of said seat back and said seat bottom after they are manipulated into a vertical face to face relationship, wherein said cap includes a plurality of depressions for securely retaining a beverage container.

* * * * *